US007648374B2

(12) United States Patent
Koskondy

(10) Patent No.: US 7,648,374 B2
(45) Date of Patent: Jan. 19, 2010

(54) USB DEVICE INSULATION SHEATH AND METHOD OF INSULATING A USB DEVICE

(76) Inventor: Ronald L. Koskondy, 1454 Morningside Ct. SE., Salem, OR (US) 97302

( * ) Notice: Subject to any disclaimer, the term of this patent is extended or adjusted under 35 U.S.C. 154(b) by 0 days.

(21) Appl. No.: 11/739,718

(22) Filed: Apr. 25, 2007

(65) Prior Publication Data

US 2008/0194144 A1 Aug. 14, 2008

Related U.S. Application Data

(60) Provisional application No. 60/889,885, filed on Feb. 14, 2007.

(51) Int. Cl.
*H01R 13/44* (2006.01)

(52) U.S. Cl. ..... 439/135

(58) Field of Classification Search ..... 439/135, 439/131, 136; 361/686, 752; D14/356
See application file for complete search history.

(56) References Cited

U.S. PATENT DOCUMENTS 4,452,052 A * 6/1984 Hodge ..... 63/1.15
6,186,400 B1 * 2/2001 Dvorkis et al. ..... 235/462.45
6,522,534 B1 * 2/2003 Wu ..... 361/686
6,808,400 B2 10/2004 Tu
6,926,544 B2 8/2005 Lee
6,969,939 B1 * 11/2005 Swensrud et al. ..... 310/201
6,979,210 B2 12/2005 Regen et al.
6,999,322 B1 * 2/2006 Lin ..... 361/752
7,104,814 B1 9/2006 She et al.
7,214,075 B2 * 5/2007 He et al. ..... 439/135
7,364,445 B1 * 4/2008 Ni et al. ..... 439/140
2006/0038023 A1 * 2/2006 Brewer et al. ..... 235/492
2007/0015393 A1 1/2007 Hu et al.

* cited by examiner

*Primary Examiner*—Alexander Gilman
(74) *Attorney, Agent, or Firm*—Dovas Law, P.C.

(57) ABSTRACT

An insulation sheath for a USB flash drive is provided. The insulation sheath includes a first silicone body with a first aperture configured to receive a USB flash drive therein. A second silicone body includes a second aperture configured to receive a USB flash drive cap therein. A combination insulation sheath and USB device is also provided. Further, a method for electrically insulating a USB device is provided.

20 Claims, 11 Drawing Sheets

USB DEVICE INSULATION SHEATH AND METHOD OF INSULATING A USB DEVICE

CROSS REFERENCE TO RELATED APPLICATION(S)

This application claims the benefit of U.S. provisional application No. 60/889,885 filed Feb. 14, 2007, which is incorporated by reference as if fully set forth.

BACKGROUND

USB flash drives have become a ubiquitous tool for storing and transporting data. These devices function without moving parts and are capable of storing large quantities of data in a very small package. Flash drives include a NAND type flash memory in connection with a USB (Universal Serial Bus) interface. The flash memory and other cooperating electronic components are stored within a typically plastic housing such that the USB flash drive can be conveniently transported for example in a pocket or on a keychain.

While USB flash drives are known to be more durable than many other types of memory storage media, they are still vulnerable to damage and loss of data. Moreover, the compact and seemingly durable appearance of such devices leads many users to be overly careless in their handling. Flash drives which may store important and irreplaceable data are often placed in environments in which other media such as CDs, DVDs or floppy disks, would not usually be exposed to. The small size of flash drives may lead them to find their way for example into a clothes washing machine, drying machine or other undesirable environment where their sensitive electronics may be subject to impact or fluid damage.

Another very serious hazard for a USB flash drive, or any electronic device, is electrostatic discharge. Many of the electronic components of a flash drive including the flash memory may be destroyed by electrostatic discharge. Such discharge may occur for example when a user who has not been properly grounded touches the flash drive sending a current through it.

USB flash drives are often a relatively inexpensive computer accessory. However, the data stored on a flash drive may be voluminous and invaluable to a user. Despite their durable appearance, flash drives may be damaged in various ways potentially resulting in serious data loss. Further, other types of USB devices such as security keys and wireless transceivers may be similarly vulnerable. Accordingly, it would be desirable to provide a device to protect a USB flash drive or other USB device from damage from electrostatic discharge, impact, and fluid exposure.

SUMMARY

The present invention provides an insulation sheath for a USB flash drive. The insulation sheath includes a first silicone body with a first aperture configured to receive a USB flash drive therein. A second silicone body includes a second aperture configured to receive a USB flash drive cap therein.

The present invention further provides a combination insulation sheath and USB device including a USB device with a housing, an electronic component within the housing, and a USB connector connected to the housing. An insulation sheath is provided with an insulating body having an aperture. The housing of the USB device is attached within the aperture of the insulating body.

The present invention also provides a method for electrically insulating a USB device. The method includes providing a USB device including a housing, an electronic component within the housing, a USB connector connected to the housing; and a cap removably connected to the housing. A first insulating body and a second insulating body are provided. The first insulating body is removably attached to the housing. The second insulating body is removably attached to the cap.

BRIEF DESCRIPTION OF THE DRAWING(S)

The foregoing Summary as well as the following detailed description will be readily understood in conjunction with the appended drawings which illustrate preferred embodiments of the invention. In the drawings.

DETAILED DESCRIPTION OF THE PREFERRED EMBODIMENT(S)

Figure 1:
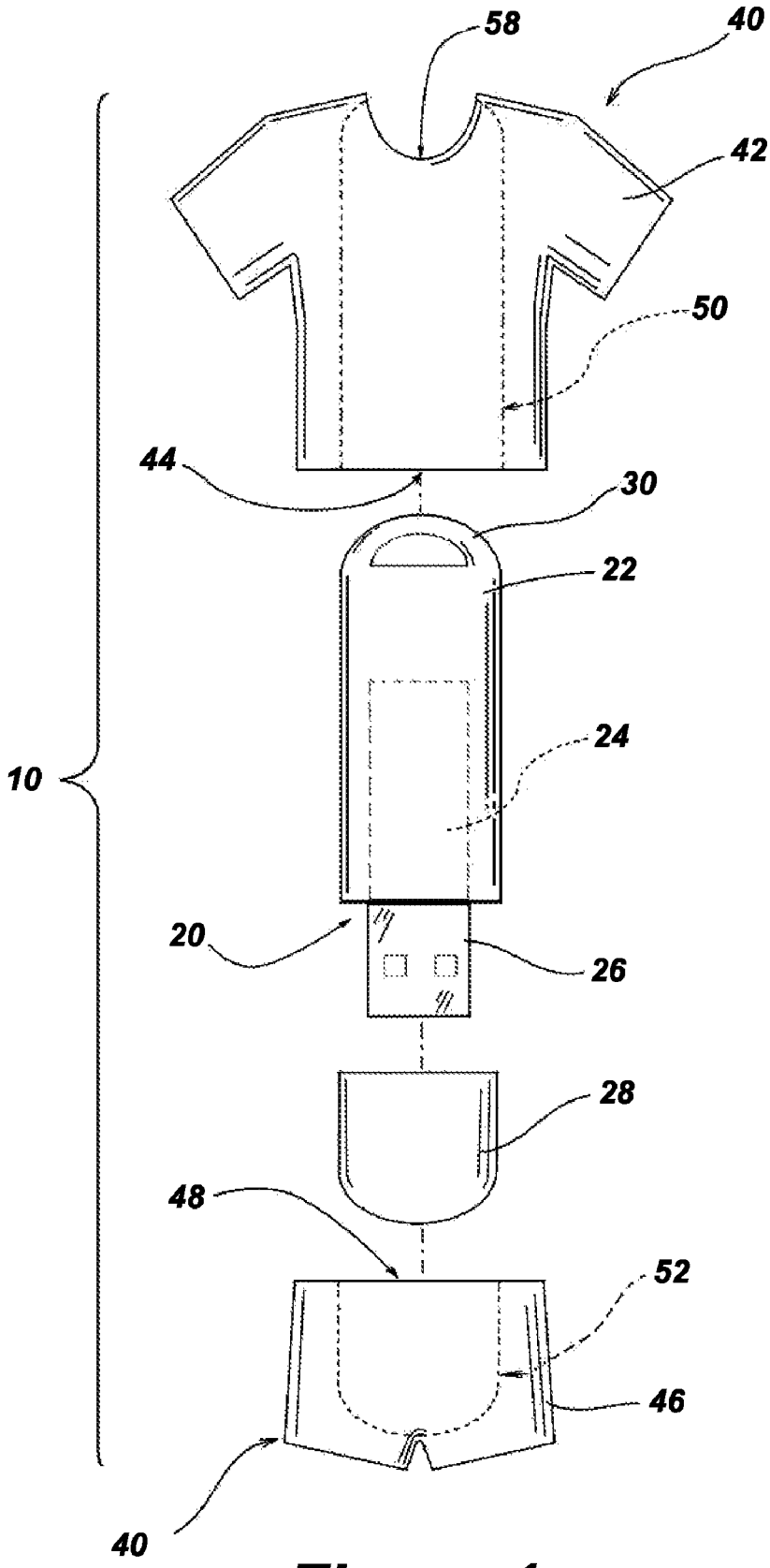
FIG. 1 shows an exploded front elevation view of an insulated USB flash drive assembly according to a first preferred embodiment of the present invention.
Figure 2:
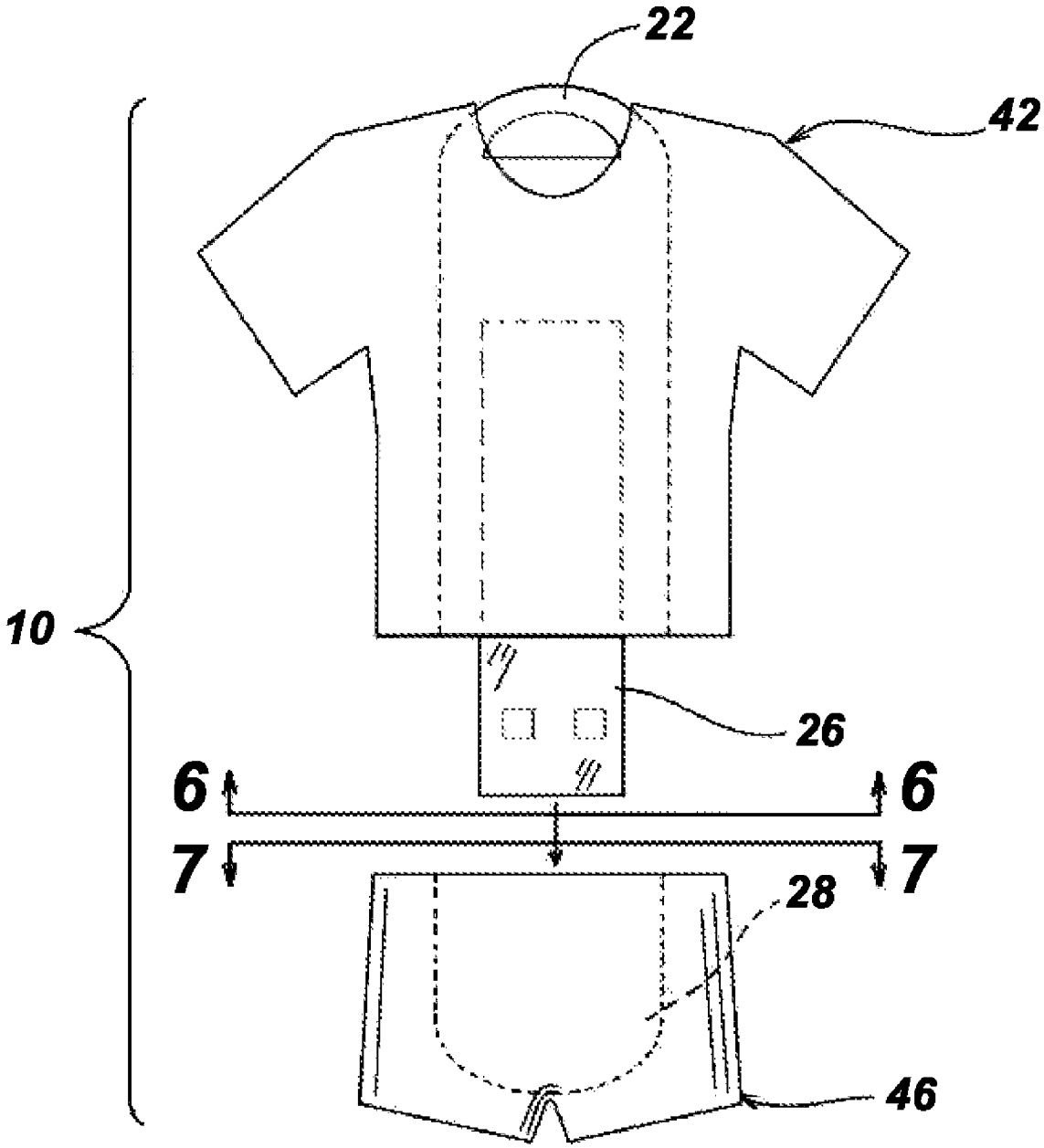
FIG. 2 shows a front elevation view of the insulated USB flash drive assembly of FIG. 1 with a first insulating body and a housing shown removed from a second insulating body and a cap of the assembly.
Figure 3:
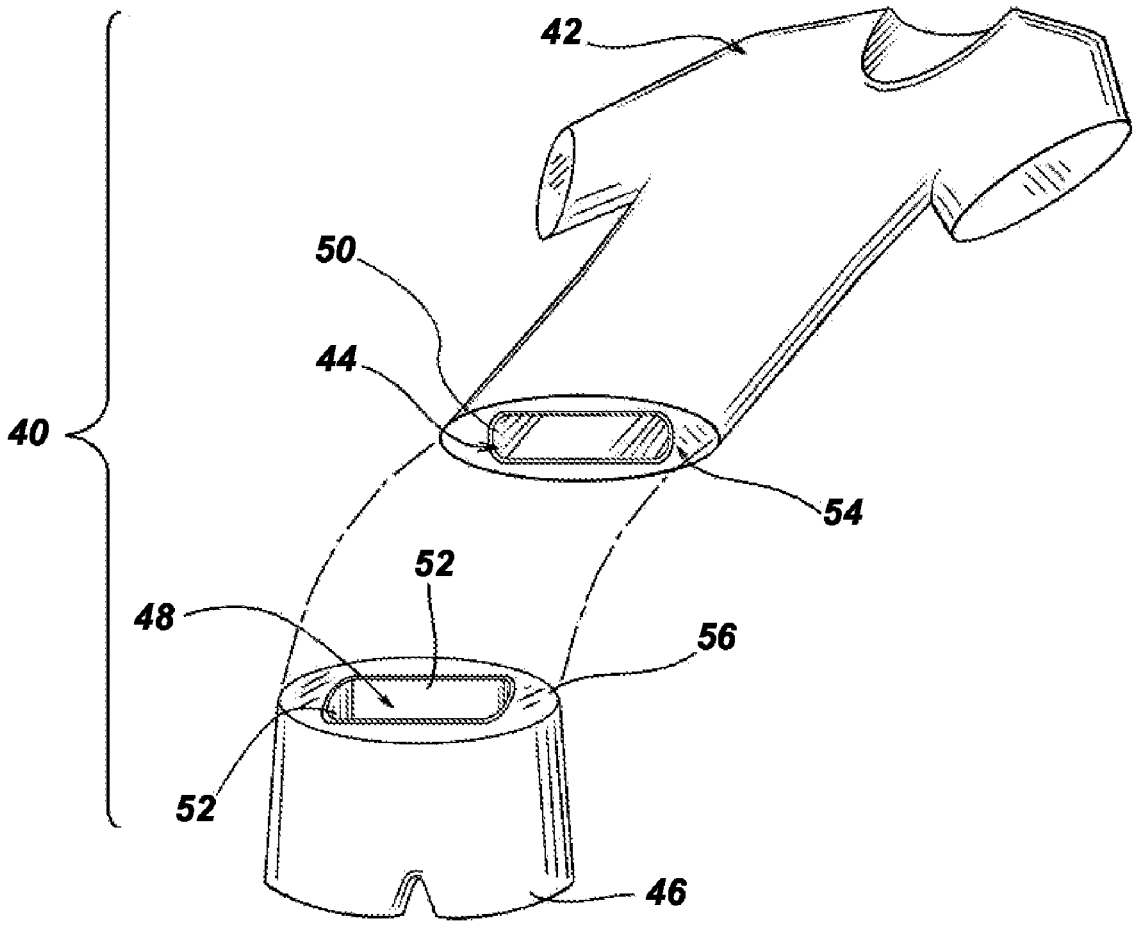
FIG. 3 is a perspective view of a two part insulation sheath of the insulated USB flash drive assembly of FIG. 1 including the first and second insulating bodies.
Figure 4:
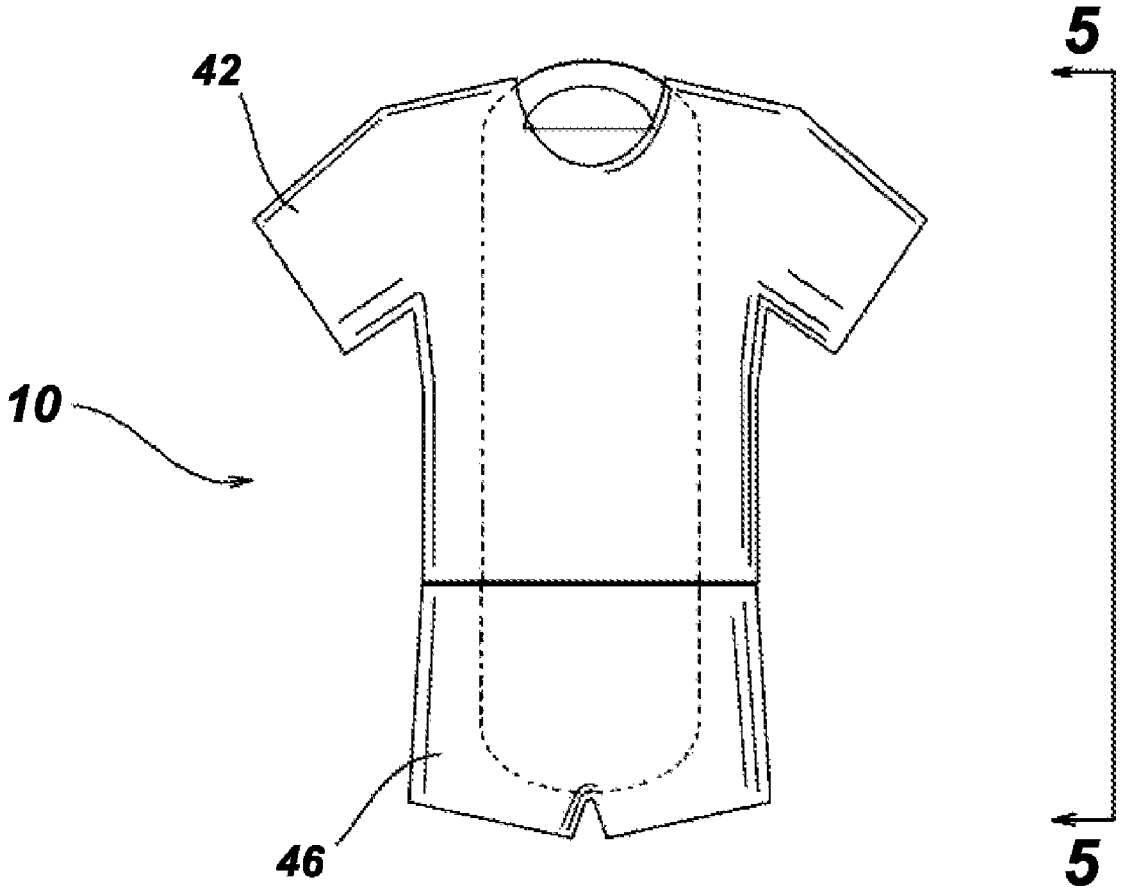
FIG. 4 is an elevation view of the insulated USB flash drive assembly of FIG. 1 fully assembled.
Figure 5:
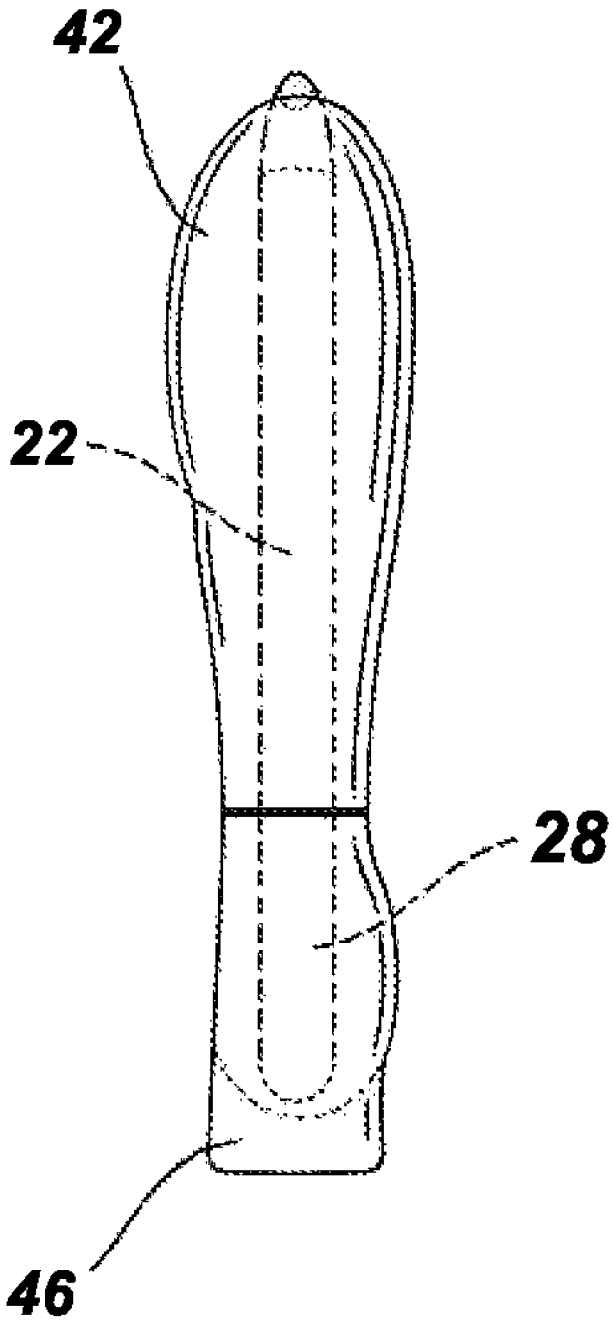
FIG. 5 is a profile view of the insulated USB flash drive assembly taken along line 5-5 of FIG. 4.
Figure 6:
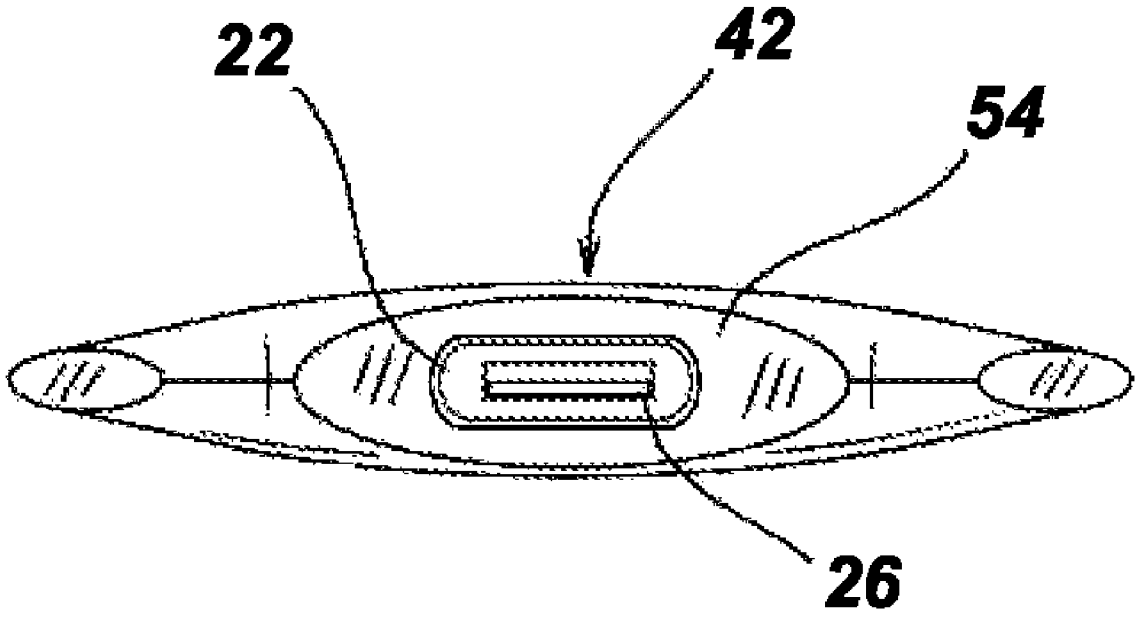
FIG. 6 is a bottom plan view of a top portion of the insulated USB flash drive assembly taken along line 6-6 of FIG. 2.
Figure 7:
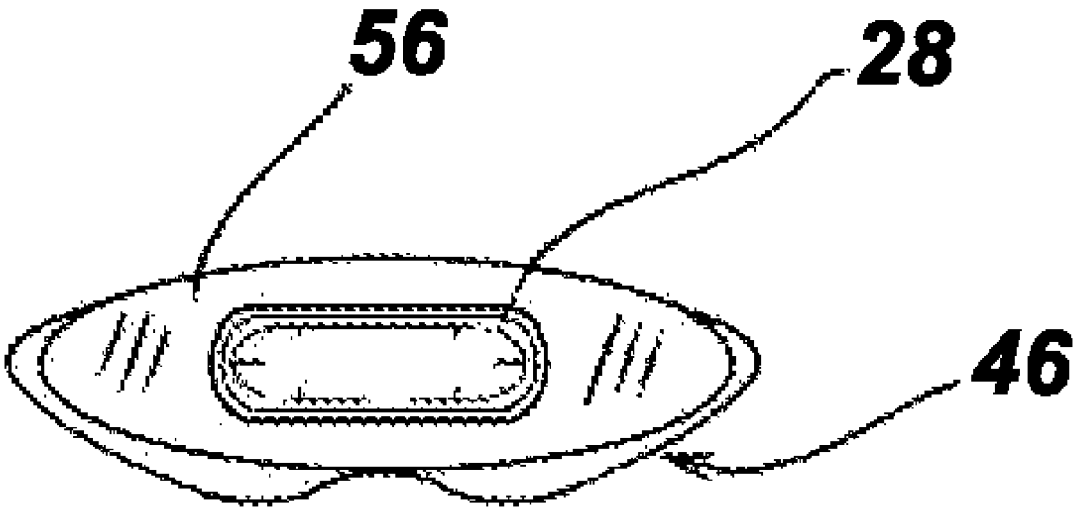
FIG. 7 is a top plan view of a bottom portion of the insulated USB flash drive assembly taken along line 7-7 of FIG. 2.

Certain terminology is used in the following description for convenience only and is not limiting. The words "right," "left," "top," and "bottom" designate directions in the drawings to which reference is made. The words "a" and "one" are defined as including one or more of the referenced item unless specifically stated otherwise. This terminology includes the words above specifically mentioned, derivatives thereof, and words of similar import. The phrase "at least one" followed by a list of two or more items, such as A, B, or C, means any individual one of A, B or C as well as any combination thereof.

The preferred embodiments of the present invention are described below with reference to the drawing figures where like numerals represent like elements throughout.

Referring to FIGS. 1 through 7, an insulated USB flash drive assembly 10 including a USB flash drive 20 and a two part insulation sheath 40 according to a first preferred embodiment of the present invention is shown. The USB flash drive 20 includes a housing 22, a flash memory chip 24 attached within the housing 22, and a USB connector 26 connected to the housing 22 and in electrical connection with the flash memory chip 24. Preferably, the USB flash drive 20 also includes a cap 28 removably connected to the housing 22 which removably covers the USB connector 26. The cap 28 may be connected to the housing 22 in any suitable manner, for example frictionally attached to the USB connector 26 or snap fit attached to a portion of the housing 22. While shown as being fully detachable from the USB connector 26, one skilled in the art will recognize that the removable cap 28 could be configured as pivotable about a portion of the housing or otherwise anchored to the portion of the USB flash drive 20 to prevent loss when it is removed. Alternatively, the USB connector 26 may be configured as retractable into the housing 22 and the cap 28 omitted. Alternatively, the USB flash drive 20 may be replaced with any other suitable USB device including for example security keys and wireless transceivers.

The insulation sheath 40 includes a first insulating body 42 having a first aperture 44 which is configured to receive the housing 22 of the USB flash drive 20 therein. The insulation sheath 40 preferably further includes a second insulating body 46 having a second aperture 48 which is configured to receive the cap 28 of the USB flash drive 20 therein. Alternatively, in the case where the cap 28 is omitted, the second insulating body 46 may be sized to fit directly onto the USB connector 26 via friction or other suitable manner, or alternatively, the second insulating body 46 may be omitted.

The first insulating body 42 and the second insulating body 46 are preferably formed from a shock absorbent, electrically insulating and thermally insulating material. More preferably, the first insulating body 42 and the second insulating body 46 include silicone material. Alternatively, any suitable insulating materials can be used for constructing the first and second insulating bodies 42,46, including Neoprene™ and other moldable polymeric materials.

The first aperture 44 and the second aperture 48 preferably include respective walls 50, 52. The walls 50 of the first aperture 44 preferably provide an interference fit between the first aperture 44 and the flash drive housing 22, and the walls 52 of the second aperture 48 preferably provide an interference fit between the second aperture 48 and the cap 28. In such a manner, the first insulating body 42 and the second insulating body 46 removably frictionally retain the USB flash drive housing 22 and the cap 28 respectively. More preferably, the walls 50, 52 include tapered portions for providing the interference fits.

The first insulating body 42 includes a first face 54 adjacent to the first aperture 44, and the second insulating body 46 includes a second face 56 adjacent to the second aperture 48. Preferably the first and second faces are in contact when the cap 28 is connected to the USB connector 26 to provide a fluid resistant seal between the first and second faces 54, 56. In such a manner, electronics within the housing 22 may be protected from fluids to which the insulated flash drive assembly 10 is exposed.

Preferably, the housing 22 includes a loop 30 for example to attach the USB flash drive 20 to a strap or the like for transport and storage. The first aperture 44 preferably extends entirely through the first insulating body 42 to provide an opening 58 through which the loop 30 can extend. Preferably, the opening 58 is sufficiently small to prevent exposure of a significant portion of the housing 22, so that the electric, thermal or shock insulating properties of the insulation sheath 40 are not substantially affected.

Figure 8:
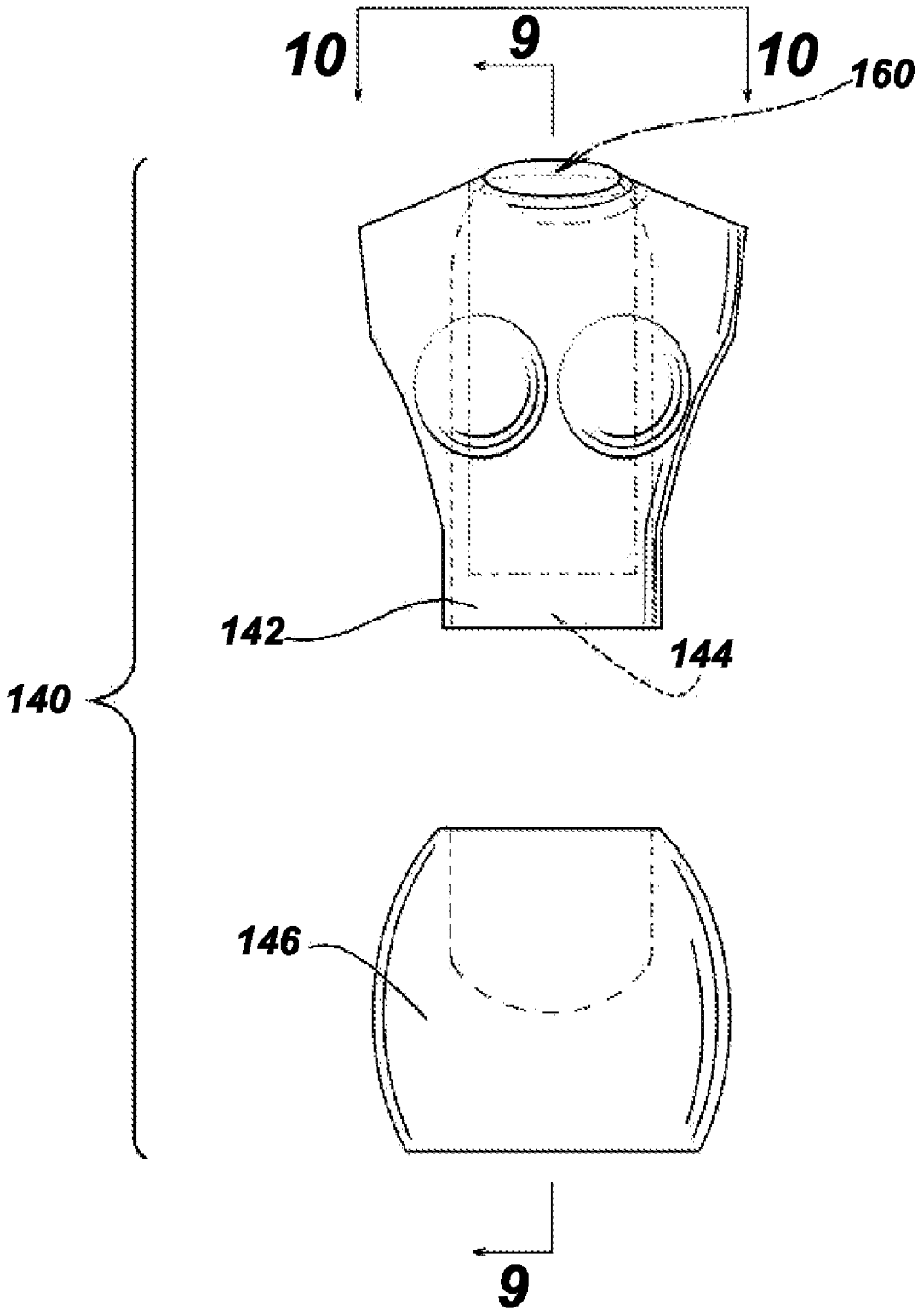
FIG. 8 is a front elevation view of a two part insulation sheath according to a second preferred embodiment of the present invention.
Figure 9:
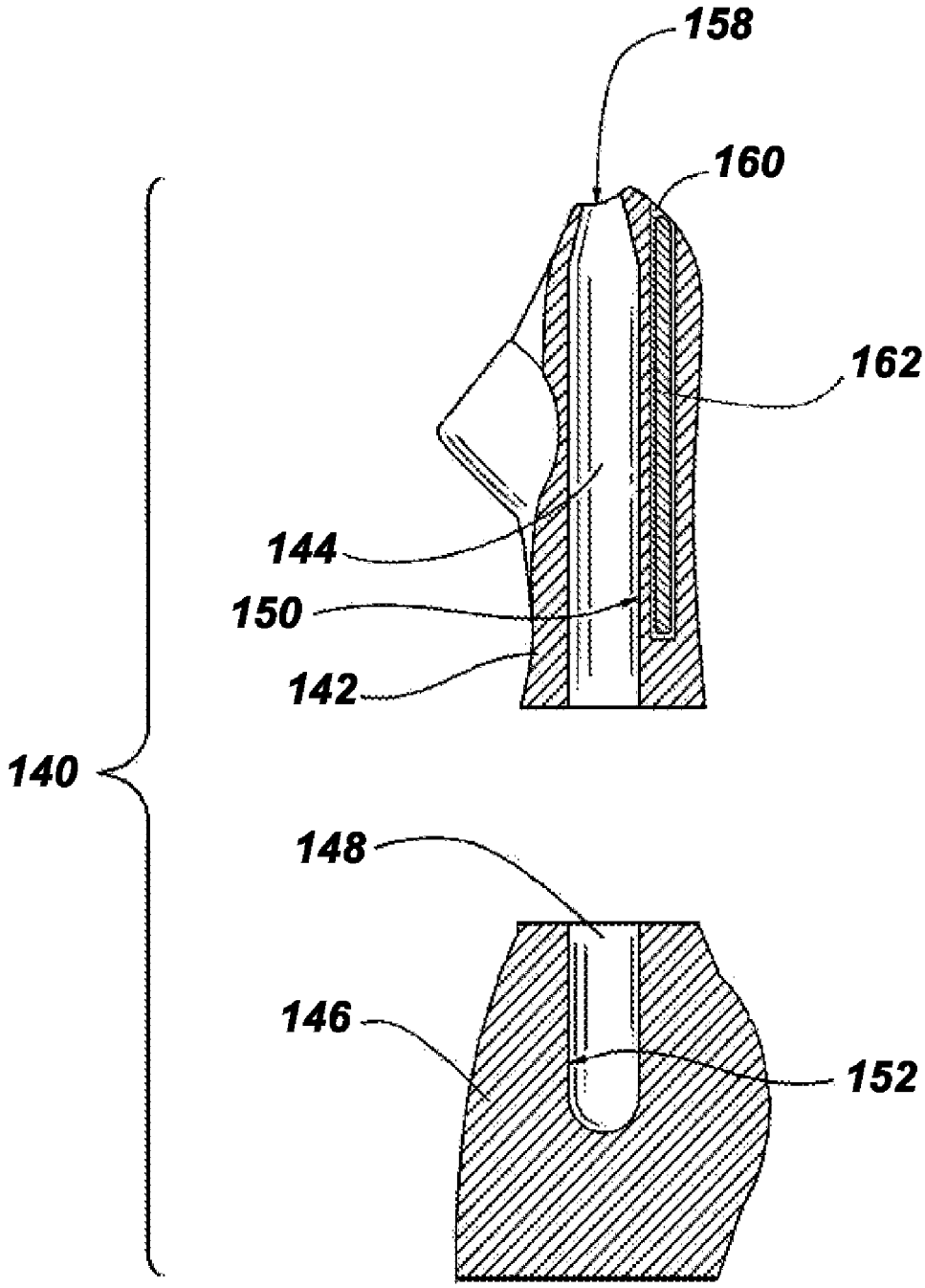
FIG. 9 is a cross-section view taken along line 9-9 of FIG. 8.
Figure 10:
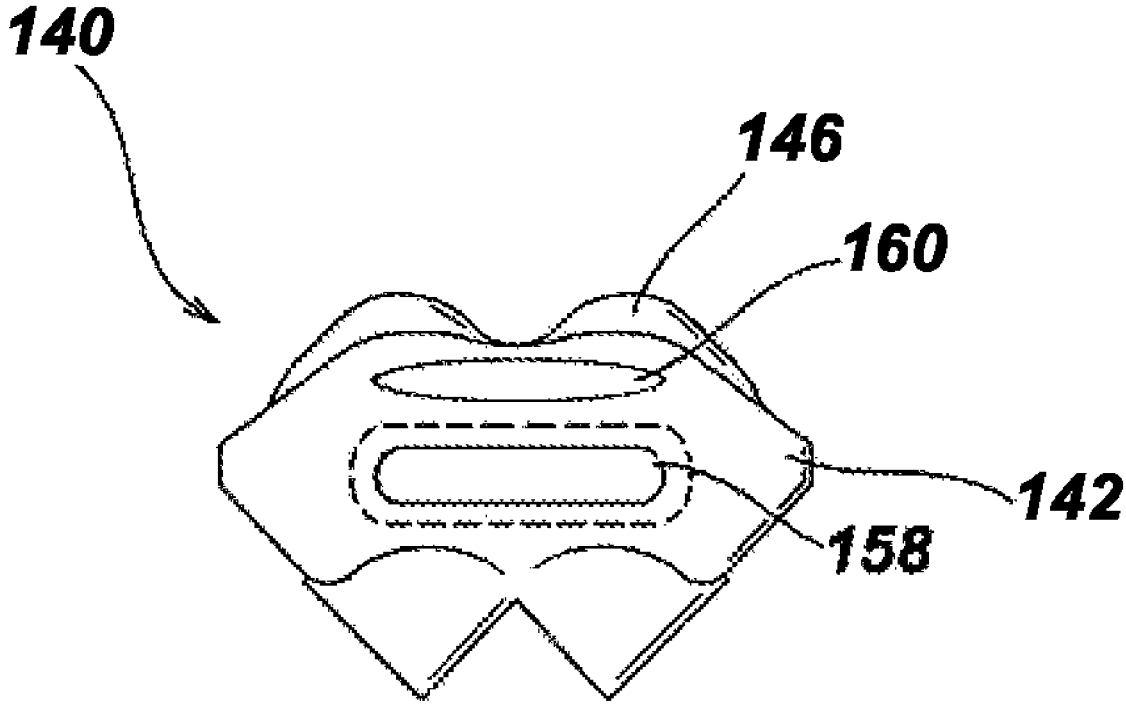
FIG. 10 is a top plan view of the two part insulation sheath of the second preferred embodiment of the present invention taken along line 10-10 of FIG. 8.

Referring to FIGS. 8-10, a two part insulation sheath 140 according to a second preferred embodiment of the present invention is shown. The two part insulation sheath 140 is configured with features functionally similar to the two part insulation sheath 40 including first and second insulating bodies 142, 146, first and second apertures 144, 148 with walls 150, 152 and an opening 158. However, the insulation sheath 140 further includes a scent composition cavity 160, which opens to the outside of the first insulating body 142, for holding a scent composition therein. The scent composition preferably includes a fluid, and an absorbent solid material 162 is preferably provided within the cavity for retaining the fluid within the cavity 160. The scent composition is preferably heat activated and more preferably includes a perfume having a volatile solvent, such that heat generated by a USB device covered by the insulation sheath 140, for example the USB flash drive 20, will cause accelerated evaporation of the solvent increasing an amount of scent composition emitted. Accordingly, the insulation sheath may function for example as an air freshener when a USB device attached therein is powered. Alternatively, any suitable non-heat activated scent composition can be provided.

While not wishing to be limited to any particular functionality for the above-described preferred embodiments, the two part insulation sheaths 40, 140 are useful for protecting the USB flash drive 20, or other suitable USB device, from damage from at least electrostatic discharge, impact, and fluid exposure. Further, the insulation sheaths 40, 140 are suitable for being formed in a variety of useful shapes to promote handling and manipulation or to serve informational or promotional purposes. Such informational or promotional purposes may include product and service advertising. For example, the sheaths 40, 140 may be formed as recognizable figures such as beverage containers, human forms, and common household items. Moreover, indicia including for example promotional material may be incorporated onto the insulation sheaths, preferably imprinted thereon using one or more of ink, paint, or a suitable embossing method.

Figure 11:
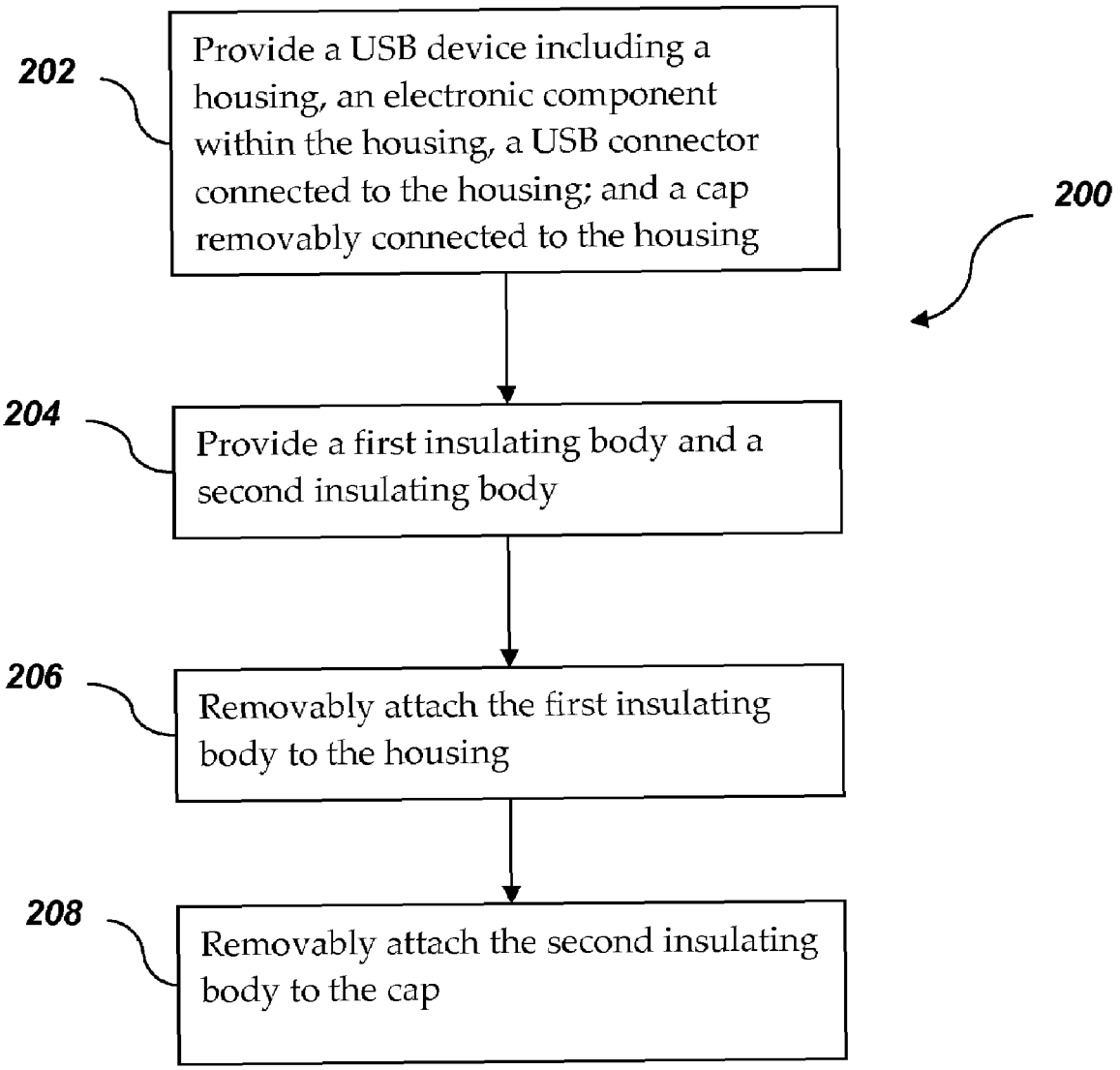
FIG. 11 is a flow chart showing a method of electrically insulating a USB device.

Referring to FIG. 11, a method 200 for electrically insulating a USB device is shown. The method 200 includes providing a USB device with a housing, an electronic component within the housing, a USB connector connected to the housing, and a cap removably connected to the housing (step 202). The USB device is preferably a USB flash memory device. A first insulating body and a second insulating body are provided (step 204). Preferably, the first and second insulating bodies include silicone material. The first insulating body is removably attached to the housing (step 206), and the second insulating body is removably attached to the cap (step 208).

While the preferred embodiments of the invention have been described in detail above, the invention is not limited to the specific embodiments described above, which should be considered as merely exemplary. Further modifications and extensions of the present invention may be developed, and all such modifications are deemed to be within the scope of the present invention as defined by the appended claims.

What is claimed is:

1. An insulation sheath for a USB flash drive comprising:

a first silicone body comprising a first aperture configured to slideably frictionally receive a housing including a loop of a USB flash drive therein and configured in the form of a first portion of a three dimensional scale model of at least one human body clothing; and a second silicone body comprising a second aperture configured to slideably frictionally receive a USB flash drive cap therein and configured in the form of a second portion of the three dimensional scale model of the at least one human body clothing;

wherein the first silicone body and the second silicone body cooperate to form the three dimensional scale model of the at least one human body clothing when the first silicone body frictionally receives the housing of the USB flash drive exposing the loop of the housing, the second silicone body frictionally receives the USB flash drive cap, and the USB flash drive cap is connected to the housing of the USB flash drive.

2. The insulation sheath of claim 1 wherein at least one of the first aperture and the second aperture includes tapered walls for providing an interference fit with the housing of the USB flash drive.

3. The insulation sheath of claim 1, further comprising:

at least one cavity within at least one of the first body and the second body; and a scented composition within the at least one cavity.

4. The insulation sheath of claim 1, further comprising:

at least one cavity within at least one of the first body and the second body; and a heat activated scented composition within the at least one cavity.

5. The insulation sheath of claim 4, further comprising an absorbent material disposed within the at least one cavity.

6. The insulation sheath of claim 1, wherein at least one of the first silicone body and the second silicone body is imprinted with promotional indicia.

7. The insulation sheath of claim 1, wherein at least one of the first silicone body and the second silicone body is shaped in a promotional form.

8. The insulation sheath of claim 1, wherein the three dimensional scale model comprises a form resembling a T-shirt and a pair of pants comprising the at least one human body clothing.

9. A combination insulation sheath and USB device comprising:

a USB device comprising a housing including a loop, an electronic component within the housing, a USB connector connected to the housing, and a cap which removably covers the USB connector; and an insulation sheath comprising a first insulating body, configured in the form of a first portion of a three dimensional scale model of at least one human body clothing comprising a first aperture, and a second insulating body, configured in the form of a second portion of the three dimensional scale model of the at least one human body clothing comprising a second aperture;

wherein the housing of the USB device is slideably, frictionally, and removably attached within the first aperture of the first insulating body exposing the loop of the housing;

wherein the cap is slideably, frictionally, and removably attached within the second aperture of the second insulating body; and wherein the first insulating body and second insulating body cooperate to form the three dimensional scale model when the cap covers the USB connector.

10. The combination of claim 9, wherein the first and second body are fluid resistant, and wherein the first insulating body includes a first face adjacent the first aperture and the second insulating body includes a second face adjacent the second aperture; wherein the first face and the second face contact when the cap is connected to the USB connector to provide a fluid resistant seal between the first face and the second face to prevent fluid from contacting the USB device.

11. The combination of claim 9, wherein the insulation sheath comprises silicone.

12. The combination of claim 9, wherein the insulation sheath comprises a pliable material, and the first aperture is sized to provide an interference fit with the housing of the USB device for removably retaining the housing within the first aperture.

13. The combination of claim 9, wherein the first aperture is tapered for removably attaching the housing within the first aperture.

14. The combination of claim 9, wherein the first insulating body comprises an opening through which the loop is exposed.

15. The combination of claim 9, further comprising:

at least one cavity within the first insulating body; and a scented composition within the at least one cavity.

16. The combination of claim 9, wherein the USB device comprises a USB flash drive which comprises a flash memory chip.

17. The combination of claim 9, wherein the three dimensional scale model comprises a form resembling at least a portion of a human body comprising the at least one human body clothing.

18. A method for electrically insulating a USB device comprising:

providing a USB device comprising a housing including a loop, an electronic component within the housing, a USB connector connected to the housing, and a cap removably connected to the housing removably covering the USB connector;

providing a first insulating body configured in the form of a first portion of a three dimensional scale model of at least one human body clothing and a second insulating body configured in the form of a second portion of the three dimensional scale model of the at least one human body clothing;

removably attaching the first insulating body to the housing exposing the loop of the housing;

removably attaching the second insulating body to the cap;

connecting the cap to the USB connector; and forming the three dimensional scale model by contacting the first insulating body to the second insulating body through cooperation of the first insulating body and the second insulating body.

19. The method of claim 18, further comprising slideably attaching the first insulating body to the housing by frictional force.

20. The method of claim 18, further comprising providing the first insulating body with silicone material.

* * * * *